US005477979A

United States Patent [19]

Goessling et al.

[11] Patent Number: 5,477,979

[45] Date of Patent: Dec. 26, 1995

[54] BEVERAGE MUG WITH REMOVABLE CLOSURE

[75] Inventors: John G. Goessling, St. Louis County; David P. Lage, Manchester, both of Mo.

[73] Assignee: Quick Point, Inc., Fenton, Mo.

[21] Appl. No.: 205,649

[22] Filed: Mar. 4, 1994

[51] Int. Cl.[6] ..... B65D 39/00

[52] U.S. Cl. ..... 220/713; 220/254; 220/719

[58] Field of Search ..... 220/711, 713, 220/719, 253, 710.5, 254, 256, 714, 715, 704, 113; 215/335, 12.1, 11.6

[56] References Cited

U.S. PATENT DOCUMENTS

| | | | |
|---|---|---|---|
| 2,796,062 | 6/1957 | Tupper | 215/11.6 |
| 3,746,198 | 7/1973 | Howland | 215/11.6 |
| 4,502,603 | 5/1985 | Hsu | 215/11.6 |
| 4,790,444 | 12/1988 | Terzi | 220/714 |
| 5,184,746 | 2/1993 | Moore et al. | 220/256 |
| 5,295,597 | 3/1994 | Green | 220/711 X |
| 5,368,186 | 11/1994 | Yeh | 220/713 |

FOREIGN PATENT DOCUMENTS

| | | | |
|---|---|---|---|
| 1229426 | 4/1971 | United Kingdom | 220/713 |
| 2181418 | 4/1987 | United Kingdom | 220/256 |

*Primary Examiner*—Allan N. Shoap
*Assistant Examiner*—Robin A. Hylton
*Attorney, Agent, or Firm*—Polster, Lieder, Woodruff & Lucchesi

[57] ABSTRACT

A beverage mug includes a vessel having an enlarged base and a neck which rises to a mouth surrounded by a rim. The mouth is normally covered by a closure that includes a lid and a sipping liner. The lid fits over and engages a sipping liner, but the liner may be detached from the lid and installed separately in the mouth of the vessel. The sipping liner has a cross wall that lies within the mouth of the vessel below the rim and thereby prevents the beverage from splashing out of the mouth, but the cross wall contains an aperture to enable one to take a beverage from the vessel in sips. The lid is fitted to the liner while the liner is on the mouth of the vessel simply by placing the lid over the liner and pressing downwardly.

22 Claims, 3 Drawing Sheets

BEVERAGE MUG WITH REMOVABLE CLOSURE

BACKGROUND OF THE INVENTION

This invention relates in general to a beverage mug and, more particularly, to a beverage mug having a unique closure as well as the closure itself.

Beverages seem to be available everywhere and likewise consumed just about everywhere —from offices, to automobiles, to construction sites, to the living and family rooms of homes. But the traditional mugs and paper or plastic drinking cups from which beverages are traditionally consumed do not have much stability nor the capacity to resist splashing. For example, the typical coffee mug is generally cylindrical and has a wide mouth. If tipped on a desk or table top, its contents can cause considerable damage —and owing to the narrow base, this possibility always exists. Then there is the traditional tapered cup, which is usually formed from coated paper, but many from molded plastic as well. While the tapered walls of this cup enables it to be nested, with like cups for easy storage, the taper reduces the size of the base and thus render the cup less stable than coffee mugs. They topple quite easily, particularly under the motion of an automobile.

The mouth of the traditional coffee mug usually represents the widest part of the mug. As a consequence, the mug is not easily carried from one place to another when filled, particularly to near capacity. The simple movement of walking or the motion produced by a moving automobile are often enough to cause the contents to splash out of the mouth of the mug. The same holds true for paper or plastic drinking cups. To be sure, snap over caps exist for paper cups, and these caps will retain the contents to a measure, but the caps do not fit tightly and leakage occurs. Moreover, some caps contain small apertures to accommodate straws or to facilitate sipping, but these apertures allow the contents to splash out of the vessel.

The present invention resides in a mug including a drinking vessel having a narrow mouth and a closure which normally fits over the mouth. The closure includes a liner and a lid which are normally united, yet may be easily separated. When the closure is installed over the mouth of the vessel, the liner extends across the mouth below its rim to prevent beverages from splashing out of the mouth. But the liner in this region has an aperture to accommodate sipping. The lid fits over the liner and mouth, covering both. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
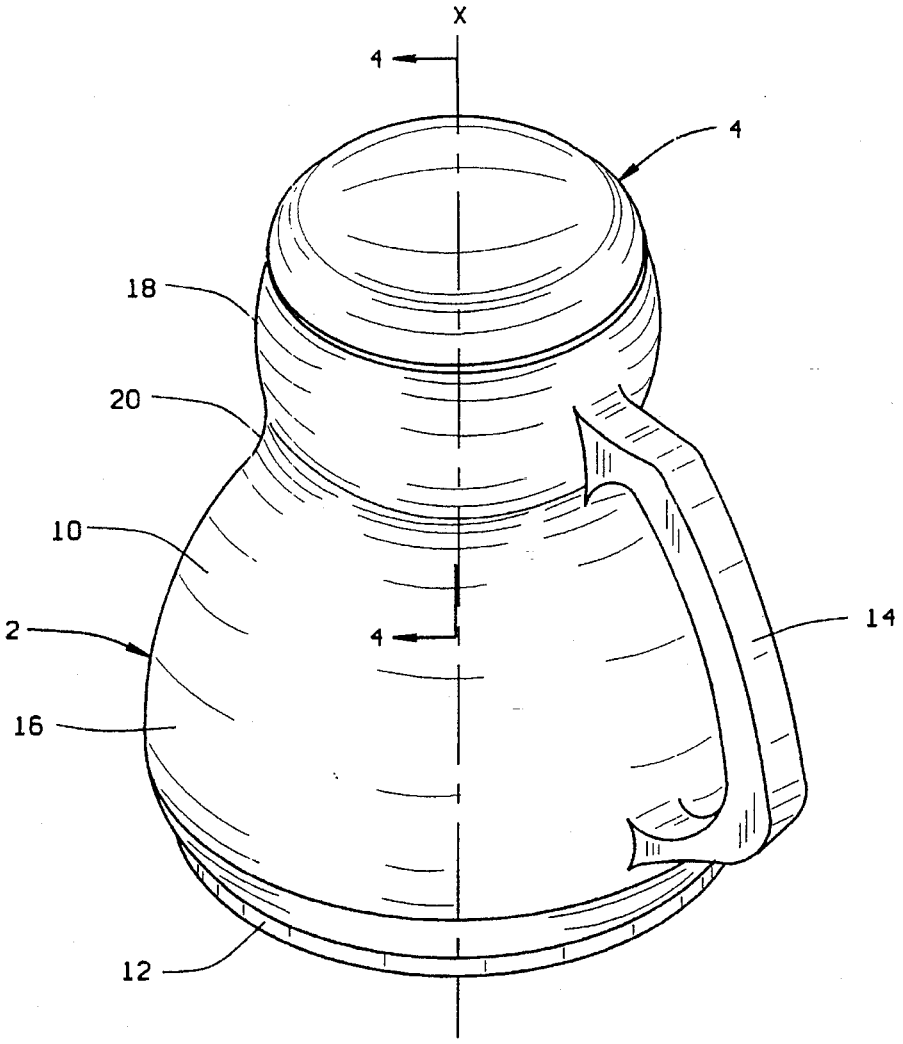
FIG. 1 is a perspective view of a beverage mug constructed in accordance with and embodying the present invention.

Referring now to the drawings, a beverage mug A (FIG. 1) includes a vessel 2 for holding the beverage, a lid 4 that fits over the vessel 2, and a sipping liner 6 (FIG. 2) that fits between the lid 4 and vessel 2. Indeed, the liner 6 engages the lid 4 such that the two are usually united in the form of a closure B (FIG. 3) that closes the vessel 2. But the liner 6 may be detached from the lid 4 and installed on the vessel 2 separately (FIG. 5), and when so installed, it likewise closes the vessel 2, but only partially, so one may take the beverage through the liner 6 in sips. When detached, the lid 4 and liner 6 are easily reunited simply by placing the lid 4 over the liner 6 while the liner 6 is on the vessel 2. The lid 4 further provides thermal insulation for the vessel 2.

The vessel 2 includes (FIG. 2) a side wall 10, a bottom wall 12 which closes the lower end of the side wall 10, and a handle 14 which projects laterally from the side wall 10. All three are formed from suitable polymer which is rigid and thus inflexible. Indeed, the side wall 10 and handle 14 are molded integral. The bottom wall 12, on the other hand, is molded separately and joined to the side wall 10 at a fluid tight joint. The side wall 10 and bottom wall 12 are circular about a center axis x, the former extending around the axis x, while the latter lies generally within a plane that is perpendicular to the axis x.

While the side wall 10 is circular in cross-section throughout its girth is varied, giving the side wall 10 a sculpted appearance. The greatest volume enclosed by the side wall 10 lies within its lower portion 16 (FIGS. 1 & 2) which represents the widest part of the side wall 10. And the greatest diameter of the lower portion exists where the side wall 10 is joined to the bottom wall 12. From this joint, the lower portion 16 flares inwardly, yet nevertheless presents a convex exterior surface, that is to say a surface which is convex both circumferentially and vertically. The lower portion merges into a neck 18 at a reduced intervening portion 20. Indeed, the neck 18 flares outwardly from the intervening portion 20 and like the lower portion presents a convex exterior surface —one that is convex both in the circumferential and vertical directions. Thus, the intervening portion 20 represents the narrowest part of the side wall 10, and it presents an exterior surface that is concave in the vertical direction and of course convex in the circumferential direction. The neck 16 rises to and terminates at a rim 22 which surrounds a mouth 24 that leads into the interior of the vessel 2. Like the rest of the side wall 10, the rim 22 and mouth 24 are circular. While the exterior surface of the neck 18 is sculpted, curving inwardly to the intervening portion 20, the interior tapered surface 26 of the neck 18 is slightly tapered (FIG. 4), its greatest diameter being at the rim 22 and its narrowest at the intervening portion 20, below which it opens into the enlarged volume enclosed by the flared lower portion 16 of the vessel 2.

The handle 14 connects with the side wall 10 at the lower portion 16 adjacent to the bottom wall 12 and at the neck 18. For the most part it follows the inclination of the lower portion 16.

The bottom wall 12 is essentially flat, but is beveled along its periphery, with its diameter being the same as the lowermost diameter of the lower portion 16 on the side wall 10, so that the joint between the bottom wall 12 and the side wall 10 is virtually imperceptible. Extended over the downwardly presented surface of the bottom wall 12, which is its exterior surface, is a pad 32 which is formed from an elastomer and is attached to the wall 12 with an adhesive. The pad 32 creates a high friction surface on the bottom of the vessel 2, and this prevents the vessel 2 from sliding over table tops and other supporting surfaces.

Figure 3:
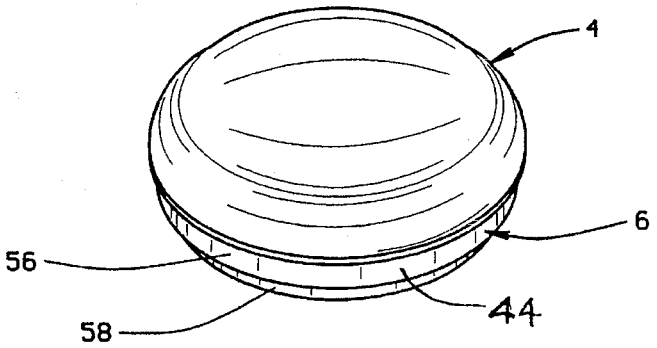
FIG. 3 is a perspective view of the lid and liner united.

The lid 4 is generally flat, at least on its top surface, but has an arcuate bevel along it periphery. In diameter, the lid 4 is slightly greater than or at least as large as the neck 18 of the side wall 10 at its rim 22 (FIG. 3). On its undersurface, the lid 4 has (FIGS. 2 & 4) an annular hub 34 which extends axially and a shoulder 36 which lies between the hub 34 and the periphery of the lid 4. The hub 34 is small enough to fit loosely into the mouth 24 of the vessel 2, and when it does, the shoulder 36 overlies the rim 22 that surrounds the mouth 24. Near its lower margin the hub 34 has a groove 38 which opens outwardly, so that the remainder of the hub 34, that is the portion located below the groove 38, exists as a narrow band 40.

Normally the lid 4 does not fit over the mouth 24 by itself, but instead is united with the sipping liner 6. Indeed, the two produce the closure B (FIG. 3) which fits snugly enough into the mouth 24 of the vessel 2 (FIG. 1) to avoid being easily dislodged as the mug A is moved about, but not so snugly to prevent easy removal when grasped and lifted upwardly.

The sipping liner 6, in contrast to the vessel 2 and lid 4, is formed from a somewhat flexible polymer. It includes (FIGS. 2 & 4) a side wall 44 which is about as deep as the hub 34 on the lid 4 and a cross wall 46 which extends across the bottom of side wall 44, for the most part closing the space encircled by the side wall 44. However, the cross wall 46 contains (FIG. 2) an elongated sipping aperture 48 and a circular vent aperture 50, both of which lie along the inside face of the side wall 44, but at opposite sides of the cross wall 46. Along the upper margin of the side wall 44 a flange 52 projects laterally away from the side wall 44 for a short distance and a tab 54 projects from the flange 52 still farther, yet remains in the plane of the flange 52. The side wall 44 is small enough to fit within the mouth 24 of the vessel 2 (FIG. 4), yet large enough to receive the hub 34 of the lid 4. When the side wall 44 lies within the mouth 24 of the vessel 2, the flange 52 overlies the rim 22 while the cross wall 46 lies depressed within the mouth 24 where it prevents the contents of the vessel from splashing out of the mouth 24.

Actually, the side wall 44, while annular, is not of uniform diameter. On the contrary, it consists of (FIG. 2 & 4) a slightly tapered upper section 56, a short lower section 58 and a beveled intervening section 60 between the sections 56 and 58. Moreover, the lower section 58 has short annular ribs 62 located at equal circumferential intervals, with each spaced equidistantly from the cross wall 46. The outside diameter of the upper section 56 is about equal to the diameter of the mouth 24 (FIG. 4), and this enables liner 6 to fit snugly into the mouth 24 with its flange 52 overlying the rim 22. And while the flange 52 extends only partially over the rim 22, the tab 54 projects out to the outer surface of the neck 18, thus enabling one to place a finger or implement under the tab 54 to lift the liner 6 and thereby remove it from the mouth 24 if one so desires.

The lower section 58 is small enough to snugly receive the hub 34 of the lid 4 (FIG. 4) and indeed, as the hub 34 advances through the side wall 44, it encounters the intervening section 60 which aligns the hub 34 with the lower section 58 and directs it into the lower section 58 if one so desires. The upper section 56 loosely receives the hub 34 of the lid 4, but the lower section 58 snugly receives it. Moreover, as the hub 34 advances through the side wall 44, the band 40 at its end encounters the beveled intervening section 60 which aligns the hub 34 with the lower section 58 and guides the hub 34 into that section. While the lower section 58 is large enough to receive the hub 34 of the lid —and indeed does with little or no resistance, the ribs 62 lie in the path of the narrow band 40 and the end of the hub 34 where they exist at a diameter less than the band 40, but not less than the groove 38 in the hub 34. The distance measured axially between the flange 52 and the ribs 62 on the liner 6 equals the distance between the shoulder 36 and the groove 38 on the lid 4. Owing to the somewhat flexible character of the polymer from which the liner 6 is molded, the side wall 44 of the liner 6 will flex as the band 40 on the hub 34 encounters the ribs 62, allowing the side wall 44 to expand enough to enable the band 40 to pass through the ribs 62. The expansion, however, lies well within the elastic limits of the polymer, so that when the groove 38 in the hub 34 reaches the ribs 62 of the liner side wall 44, the ribs 62 snap into the groove 38, thereby engaging the lid 4 and liner 6 so that they do not separate when moved about as a unit.

Figure 5:
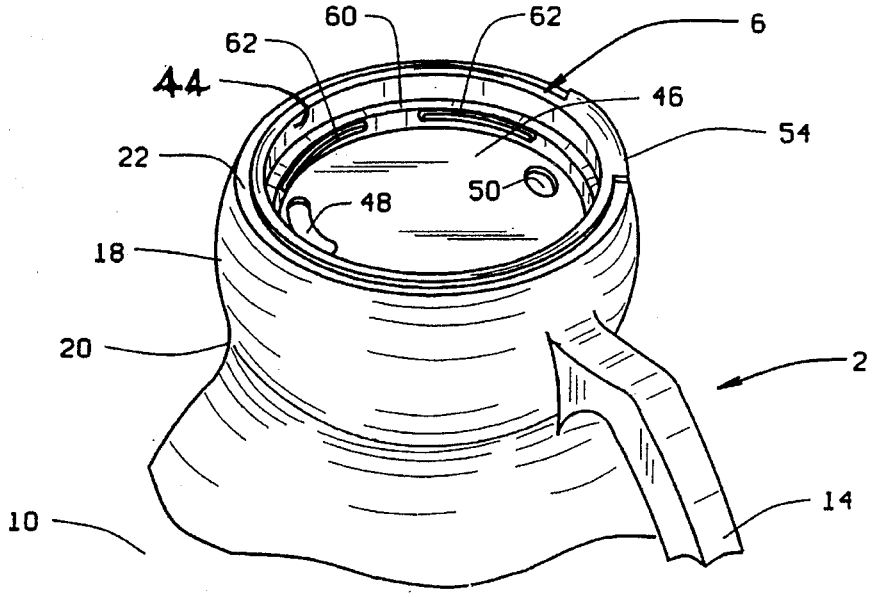
FIG. 5 is a fragmentary perspective view of the vessel with only the liner installed in its mouth.

When the lid 4 and liner 6 are so engaged, the tab 54 of the liner 6 projects out to the periphery of the lid 4 where it may be engaged with one's finger or an implement to force the flange 52 in the region of the tab 54 away from the shoulder 36 on the lid 4. This causes the liner 6 along the opposite part of its flange 52, that is in the region of the sipping aperture 48, to pivot on the shoulder 36 of the lid 4. As a consequence, the ribs 62 in the region of the vent aperture 50 move out of the groove 38, over the narrow band 40, and off the end of the hub 34, thus freeing the sipping liner 6 from the lid 4. Once free the sipping liner 6 may be inserted by itself into the mouth 24 of the vessel 2 to establish a closure for the mouth 24 (FIG. 5).

When the mug A is stored, the lid 4 fits over the mouth 24 on the neck 18 of the vessel 2 with the liner 6 interposed between the neck 18 and the lid 4. The closure B so formed keeps the interior of the vessel 2 clean. To fill the vessel 2, one merely removes the lid 4 to expose the mouth 24 and through it the full interior of the vessel 2. Since the liner 6 is engaged with the lid 4 at the ribs 62, which project inwardly from the liner 6 into the groove 38 in the lid 4, the liner 6 remains with the lid 4 and comes off with the lid 6, obviously, without distortion of the liner 6. Should one desire to take a beverage from the vessel 2, one may do so simply by raising the uncovered mouth 24 of the vessel 2 to one's lips and drinking much the same as from a traditional coffee mug. On the other hand, should one fear having the beverage splash from the vessel 2, notwithstanding its flared side wall 10 and narrow neck 18, one may do so simply by separating the liner 6 from the lid 4 and installing it in the mouth 24 of the vessel 2 (FIG. 5). In this regard, the side wall 44 of the liner 6 fits snugly into the mouth 24 of the vessel 2, with its flange 52 overlying the rim 22 of the vessel 2. This presents the cross wall 46 of the liner 6 within the mouth 24 below the rim 22 where it prevents the beverage from splashing out of the mouth 24. To be sure, some of the beverage may come through the sipping and vent apertures 48 and 50, but only a very small amount and certainly not enough to overflow from the cup-like interior of the liner 6. With the liner 6 in place, one may still take the beverage from the vessel 2 simply by sipping it through the sipping aperture 48 in the liner 6.

Figure 2:
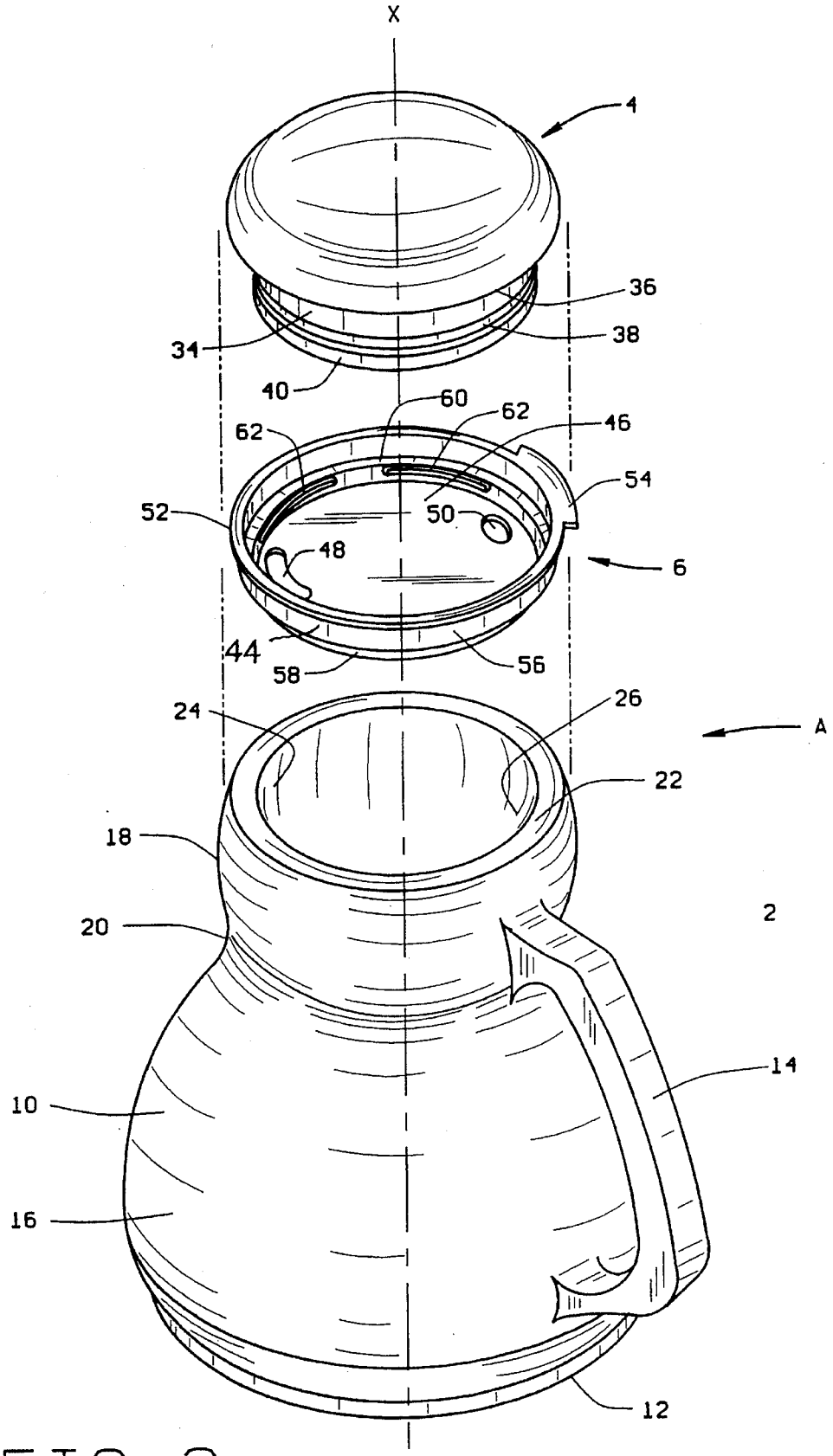
FIG. 2 is an exploded perspective view of the mug, its vessel, liner and lid being separated.
Figure 4:
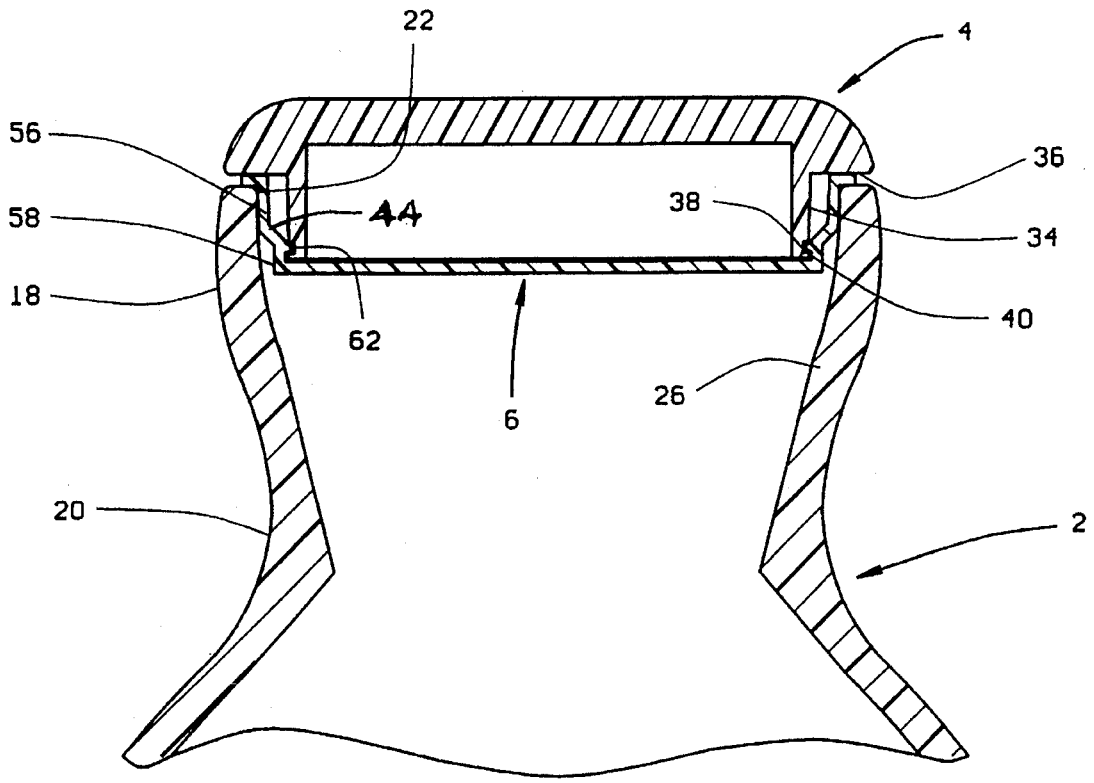
FIG. 4 is a sectional view of the mug taken along line 4—4 of FIG. 1.

If one desires to put the vessel 2 aside for a while, with the beverage remaining in it and protect the liner 6 as well as add an extra measure of thermal insulation, one simply places the lid 4 over the liner 6 that is already on the vessel 2. The hub 34 fits into the side wall 44 of the liner 6, it being guided first by the large upper section 56 of the side wall 44, then by the beveled intervening section 60, and finally by the small lower section 58. The band 40 at the lower end of the hub 34 spreads the ribs 62 on the liner 6 and passes through them, whereupon the ribs 62 snap into the groove 38 and secure the lid 4 to the liner 6, with the shoulder 36 of the former being against the flange 52 of the latter (FIGS. 1 & 4). Now the lid 4 and liner 6 are united and must be removed from the mouth 24 of the vessel 2 as a unit.

This invention is intended to cover all changes and modifications of the example of the invention herein chosen for purposes of the disclosure which do not constitute departures from the spirit and scope of the invention.

What is claimed is:

1. A mug comprising: a vessel configured to hold a beverage and having an upwardly opening mouth and a rim surrounding the mouth; a liner having a side wall that fits within the mouth of the vessel and a cross wall which extends across the side wall at the lower end thereof to generally close the mouth of the vessel, the side wall being fitted snugly, yet removably into the mouth of the vessel, such that the liner may be easily removed from the vessel without excessive distortion, the cross wall containing an aperture through which a beverage may be taken from the vessel, the aperture lying generally at the level of the cross wall and being unobstructed at that level; and a lid fitted over and covering the liner, the lid being continuous over the cross wall of the liner so that it covers the aperture in the cross wall irrespective of its position on the liner, the lid being engaged with the liner such that the lid and liner are normally held together as a unit, but are easily separable.

2. A mug according to claim 1 wherein the liner further includes a flange which projects from the upper end of the side wall and overlies the rim of the vessel, and the lid has a shoulder which projects beyond the hub and overlies the flange of the liner.

3. A mug according to claim 1 wherein the lid has a hub which fits into the side wall of the liner; and wherein the lid lies above and covers the cross wall of the liner.

4. A mug according to claim 3 wherein the lid along its hub engages the liner along its side wall.

5. A mug according to claim 4 wherein the lid projects laterally beyond its hub and overlies the flange on the liner and the rim of the vessel.

6. In combination with a vessel having a bottom wall and a side wall that rises upwardly to a mouth surrounded by a rim and encloses a hollow interior, a closure for closing the mouth of the vessel, said closure comprising: a liner fitted to the vessel at the mouth of the vessel such that the liner is removed from the vessel, the liner having a side wall which fits snugly into the mouth of the vessel, a flange which projects laterally from the top of the side wall and overlies the rim to prevent the liner from dropping into the vessel, and a cross wall which extends across the bottom of the liner side wall and substantially closes the mouth below the rim, the cross wall having a sipping aperture located proximal the side wall for taking a beverage from the vessel; and a lid which extends across the mouth of the vessel and covers the liner, the lid having a shoulder which overlies the flange of the liner and the rim of the vessel, and a hub which projects downwardly into and fits snugly within the side wall of the liner, the hub of the lid engaging the liner such that the lid and liner normally remain together, but are separable so that only the liner is on the vessel, the hub of the lid containing a groove which opens laterally outwardly and a narrow band below the groove; the side wall of the liner having inwardly directed ribs which exist at a diameter less than the band on the hub of the lid and, when the lid and liner are engaged, project into the groove in the hub of the lid to hold the lid and liner together.

7. The combination according to claim 6 wherein the lid is formed from a relatively rigid material and the liner from a relatively flexible material, so that the side wall of the liner will expand to accommodate the movement of the band through the ribs.

8. The combination according to claim 6 wherein the liner is further provided with a tab which projects laterally from the flange to facilitate separation of the lid and liner and removal of the liner from the mouth of the vessel.

9. A closure for a drinking vessel, said closure comprising a liner having an annular side wall, a cross wall extended across the side wall at its lower end and substantially closing the area surrounded by the side wall, but containing a sipping aperture, and a flange which projects downwardly laterally from the side wall; and a lid located over the liner and being substantially continuous over the cross wall of the liner so as to cover the sipping aperture in the cross wall, the lid having a hub which projects downwardly into the side wall of the liner, the lid also having a shoulder projecting laterally beyond the hub and overlying the flange of the liner, the lid at its hub being engaged with the side wall of the liner such that the lid and liner are normally held together as a unit, but are easily separable.

10. A closure according to claim 9 wherein the hub of the lid has a groove which opens laterally, and the side wall of the liner has ribs which project into the groove, whereby the liner and lid are engaged.

11. A mug comprising: a vessel configured to hold a beverage and having an upwardly presented mouth and a rim surrounding the mouth; a liner fitted to the vessel such that it extends across the mouth of the vessel and substantially closes the mouth of the vessel, the liner having an annular side wall that lies along the vessel at the interior surface of its mouth and a flange which overlies the rim and prevents the liner from dropping into the vessel, the liner also having a cross wall which extends across the mouth of the vessel below the rim when the liner is in the vessel and contains a sipping aperture through which a beverage may be taken from the vessel, the liner further having projections which extend laterally from the side wall, the liner being removable from the mouth of the vessel; and a lid fitted over the mouth of the vessel and substantially continuous over the liner, the lid being above and covering the cross wall of the liner so as to completely cover the cross wall of the liner, the lid having a downwardly projecting hub which fits into the side wall of the liner, the lid further having a shoulder which projects laterally beyond the hub to overlie the flange on the liner and the rim of the vessel, the hub containing an annular groove adjacent the lower end thereof which opens laterally toward the side wall of the liner and receives the projections on that side wall when the lid and liner are together, all such that the hub and liner are engaged and are removable from and placed on the vessel as a unit.

12. A mug according to claim 11 wherein the lid is formed from a relatively inflexible material and the liner is formed from a relatively flexible material, so that the liner will yield to enable its projections to pass over the hub of the lid and into the groove.

13. A mug according to claim 12 wherein the side wall of the liner has a large section and a small section which are offset axially, the large section fitting snugly into the mouth of the container and the small section fitting snugly over the hub of the lid.

14. A mug according to claim 13 wherein the projections are on the small section of the side wall for the liner.

15. A mug according to claim 14 wherein the projections are arcuate ribs.

16. A mug according to claim 11 wherein the liner further includes a tab which projects laterally from the flange to facilitate disengagement of the liner from the lid or removal of the liner from the mouth of the vessel.

17. A mug according to claim 11 wherein the vessel flares outwardly below its mouth.

18. A mug comprising: a vessel configured to hold a beverage and having an upwardly presented mouth and a rim surrounding the mouth; a liner snugly, yet removably, fitted to the vessel at its mouth, the liner including a side wall which fits into the mouth along the surface of the mouth, a flange which projects laterally beyond the side wall and overlies the rim, and a cross wall which extends across the side wall below the flange and lies within the mouth of the vessel, whereby the cross wall is depressed with respect to the flange and rim, the cross wall containing an aperture proximal the side wall to enable a beverage to be taken from the vessel with the liner in the mouth of the vessel; and a lid located over the liner and over the mouth of the vessel and including a hub which projects downwardly into and lies along the side wall of the liner, the lid being continuous over the cross wall of the liner so that it covers the aperture in the cross wall of the liner irrespective of its position on the liner, the lid at its hub being engaged with the liner.

19. A mug according to claim 18 wherein the hub of the lid is engaged with the side wall of the liner to hold the lid and liner together as a unit.

20. A mug according to claim 19 wherein the hub of the lid contains a groove which opens toward the side wall of the liner, and the liner includes a rib which projects from the side wall into the groove on the hub of the lid to engage the lid with the liner.

21. A mug according to claim 18 wherein the lid projects laterally beyond its hub and includes a shoulder which overlies the flange of the liner.

22. A mug according to claim 21 wherein the liner further includes a tab which projects laterally from the flange to facilitate removal of the liner from the mouth of the vessel.

* * * * *

UNITED STATES PATENT AND TRADEMARK OFFICE

CERTIFICATE OF CORRECTION

PATENT NO. : 5,477,979
DATED : Dec. 26, 1995
INVENTOR(S) : John G. Goessling, David P. Lage It is certified that error appears in the above-indentified patent and that said Letters Patent is hereby corrected as shown below:

Claim 6
Col. 5, line 47 - delete "removed" and insert ---removable---

Claim 9
Col. 6, bridging lines 14 & 15 - after "flange" delete "which projects downwardly" and insert ---projecting---

Signed and Sealed this

Thirty-first Day of December, 1996

*Attest:*

*Attesting Officer*

BRUCE LEHMAN

*Commissioner of Patents and Trademarks*